US009010342B2

(12) United States Patent
Orr

(10) Patent No.: US 9,010,342 B2
(45) Date of Patent: Apr. 21, 2015

(54) SYNTHETIC MICROFIBER WIPING CLOTHS

(76) Inventor: Nailah Orr, Carmel, IN (US)

( * ) Notice: Subject to any disclaimer, the term of this patent is extended or adjusted under 35 U.S.C. 154(b) by 0 days.

(21) Appl. No.: 13/587,303

(22) Filed: Aug. 16, 2012

(65) Prior Publication Data

US 2013/0042879 A1 Feb. 21, 2013

Related U.S. Application Data

(60) Provisional application No. 61/524,517, filed on Aug. 17, 2011.

(51) Int. Cl.

| | |
|---|---|
| ***A45D 40/26*** | (2006.01) |
| ***D21H 27/30*** | (2006.01) |
| ***D21H 13/10*** | (2006.01) |
| ***D21H 13/24*** | (2006.01) |

(52) U.S. Cl.
CPC ..... *D21H 27/30* (2013.01); *D21H 13/10* (2013.01); *D21H 13/24* (2013.01)

(58) Field of Classification Search
USPC ..... 15/118, 244.3; 132/320, 215; 30/32, 30/34.05, 50
See application file for complete search history.

(56) References Cited

U.S. PATENT DOCUMENTS

| | | | | |
|---|---|---|---|---|
| 4,923,454 | A * | 5/1990 | Seymour et al. | 604/368 |
| 6,062,234 | A * | 5/2000 | Finocchiaro et al. | 132/320 |
| 6,167,890 | B1 * | 1/2001 | Gueret | 132/200 |
| 6,494,767 | B2 * | 12/2002 | Fisher | 451/28 |
| 6,977,113 | B2 * | 12/2005 | Kody et al. | 428/292.1 |
| 2006/0049386 | A1 * | 3/2006 | Kody et al. | 252/500 |
| 2009/0038174 | A1 * | 2/2009 | Hoffman-Lubitch | 34/95 |
| 2009/0056048 | A1 * | 3/2009 | Sharifi | 15/210.1 |
| 2010/0249736 | A1 * | 9/2010 | Png et al. | 604/365 |
| 2012/0144688 | A1 * | 6/2012 | Hoffman-Lubitch | 34/282 |

OTHER PUBLICATIONS https://store.haloheadband.com Dec. 11, 2014.
www.headlineit.com Dec. 11, 2014.

* cited by examiner

*Primary Examiner* — Rachel Steitz
*Assistant Examiner* — Jennifer Gill
(74) *Attorney, Agent, or Firm* — Thomas D. Webster; TDW Patents & Consulting

(57) ABSTRACT

Synthetic microfiber articles of manufacture and methods for use in consumer applications for absorbing liquids and cleaning surfaces.

1 Claim, 5 Drawing Sheets

SYNTHETIC MICROFIBER WIPING CLOTHS

CROSS REFERENCE TO RELATED APPLICATIONS

Figure 1A:
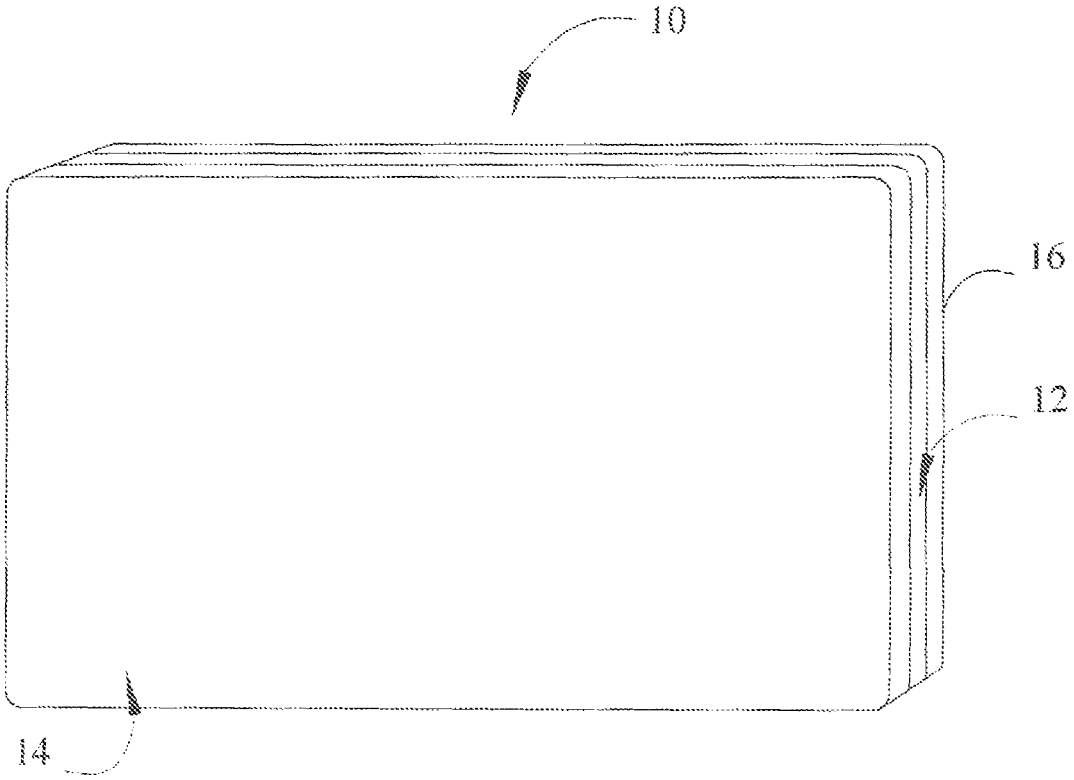

This application claims the benefit of U.S. Provisional Application No. 61/524,517, filed Aug. 17, 2011.

FIELD OF THE INVENTION

The present invention relates to absorbent synthetic microfiber wipes and uses thereof.

BACKGROUND OF THE INVENTION

Cloths and other wiping products for absorbing liquids are widely known and used. Most wipes are made from woven or nonwoven sheets of natural or synthetic fiber material. The present invention relates to synthetic microfiber wipes for consumer applications.

Various materials capable of cleaning surfaces and or absorbing liquids, particularly aqueous liquids, are employed in the manufacture of products for use as wipes, towels (cloth or paper), and various specialty items including diapers, wound dressings, medical sponges, tissues, napkins, liners, toilet paper, tampons, sanitary napkins, towelettes, and cleaning wipes. These and other related items have traditionally been prepared from cloth or paper, but recent developments have resulted in a number of new absorbent materials having different chemistries and molecular structures, such as blown microfibers, staple fibers, ion exchange fibers, and conjugate fibers of differing melting points. See for example, U.S. Pat. Nos. 4,851,284; 4,818,598; and 4,865,596.

Wipes are widely used in industry and by consumers, as a convenient way to quickly absorb polar (e.g., water and alcohols) and non-polar liquids (e.g., oil). Wipes must have sufficient capacity to absorb and retain a liquid until discharge of the liquid or disposed of the wipe (i.e. one-time use). In addition, it is generally desirable that a wipe possess good physical strength and abrasion resistance in order to withstand tearing, stretching and abrading forces encountered during use. Additionally, it may also be desirable that a wipe have a soft feel, especially for consumer and/or personal use applications.

The need to absorb and retain liquids, including aqueous and non-aqueous fluids emitted from a human or other mammalian body is common in everyday life, both for convenience and health reasons. For example, accidental spills occur in a typical household prompting the need for quick and efficient clean-up. Similarly, fluid emissions or discharges from the human body, e.g. sweat, urine, blood, oils, or menstrual flow, may create the need to absorb bin-based liquids, for comfort and/or health reasons.

Over the years, a variety of wipes and the like have been developed, oil of which, to one extent or another, are designed to absorb liquids. In the past, articles of this type have been fashioned from natural fibers such as cotton, flax, cellulose, paper, or blended fibers which have the capacity to absorb liquids. In some cases, a product is designed to be used once and then disposed of, while other products are designed for reuse. In any event, such products must efficiently absorb liquids in order to fulfill their purpose.

Recently-introduced synthetic microfiber fabrics are advantageous over natural materials such as cellulose at collecting dirt and dust.

U.S. Pat. No. 6,946,196 discloses antimicrobial containing microfibers for use in a variety of consumer articles, including garments and filters, and in medical articles including wound and burn dressings.

U.S. Pat. No. 4,468,428 teaches hydrophilic microfiber non-woven web materials made from cellulose or a synthetic thermoplastic of at least 50% microfibers for use in medical and consumer products such as surgical sponges, drapes and tampons.

U.S. Pat. No. 7,240,391 discloses synthetic microfiber cloths, optionally treated with anti-microbial agents for use in constructing a hand-worn wiping and cleaning device.

While the prior art addresses some of the needs associated with absorbing liquids in consumer and non-consumer environments, unmet needs remain.

Accordingly, there is a need for better products for use in absorbing liquids for personal and other consumer applications.

SUMMARY OF THE INVENTION

The present invention provides articles of manufacture including but not limited to, wipes for personal and/or other consumer use fabricated at least in part from synthetic microfiber material for a variety of uses involving liquid absorption and/or cleaning of objects and/or surfaces.

Microfiber articles according to the present invention provide superior performance for cleaning and/or liquid absorption in comparison with other products made from traditional materials such as paper or cloth. Articles according to the present invention are designed to provide softness and comfort for personal use and more efficient liquid absorption and cleaning capacity.

The present invention relates to articles of manufacture including but not limited to wipes comprising microfiber material for use in absorbing liquids, e.g. water, sweat, dust and/or oil from the skin of a mammal including a human, or other surface.

In one embodiment, microfiber articles according to the present invention relate to wipes for personal use including for wiping the face or other site on the body to remove sweat and/or oils, or other substance, wherein the wipe provides a soft, comfortable feel on the skin.

In another embodiment, a microfiber wipe is used to apply and/or remove make-up.

In another embodiment, articles according to the invention relate to wipes for use in removing or cleaning dust and/or oil, or other debris from electronic equipment such as smartphones, tablets, computer screens or other surfaces on electronic equipment.

In yet another embodiment, the present invention relates to towels, pads, clothing, personal hygiene products, incontinence garments, underwear, pajamas, diapers, baby wipes, baby bibs, filters, mattress pads, bed sheets, pillow covers, blankets, towels, table linen, jewelry cleaning cloths, carpets, carpet pads, bedding, and sports wear including but not limited to head bands, wrist bands, sweat bands, and post-swim clothing.

It is an object of the present invention to provide a wipe fabricated at least in part or wholly from synthetic microfiber for personal, hygienic, work, leisure, or sports use.

It is another object of the present invention to provide a multi-layered wipe for personal use fabricated at least in part or wholly from synthetic microfiber material.

It is another object of the present invention to provide a multi-layered wipe for personal use fabricated at least in part or wholly from synthetic microfiber material which is from about 0.1 to about 0.5 inches in thickness; alternatively from about 2 mm to about 15 min in thickness.

It is a further object of the present invention to provide a multi-layered wipe fabricated at least in part or wholly from synthetic microfiber material having at least 3 layers.

It is yet a further object of the present invention to provide a multi-layered pad or wipe fabricated from synthetic microfiber material having at least 3 layers for consumer use wherein the article has any desired shape including, but not limited to, a flower shape, star shape, or a geometric shape.

It is yet a further object of the present invention to provide a wipe or other article of manufacture fabricated at least in part or wholly from synthetic microfiber material having at least 3 layers and wherein the wipe or other article has an out surface that comprises one or a plurality of segments or sectors that facilitate liquid absorption and/or use of the article in consumer applications.

It is another object of the present invention to provide a method to maximize absorption of liquids, for example, in personal use for absorbing sweat and/or oils, or in applying or removing make-up by use of a microfiber wipe.

It is another object of the present invention to provide methods for absorbing oils from environmental surfaces, or from the skin of a mammal including humans (e.g. oils from the face), by use of a synthetic microfiber cloth of the invention.

It is another object of the present invention to provide improved articles of manufacture and methods for cleaning electronic equipment surfaces including screens on computers, notebooks, and smart phones.

These and other objects and advantages of the present invention will be apparent from the following description, the accompanying drawing, and the appended claims.

BRIEF DESCRIPTION OP THE DRAWINGS

FIG. 1*a* provides a schematic representation of a multi-layered wipe according to one aspect of the invention.

Figure 1B:
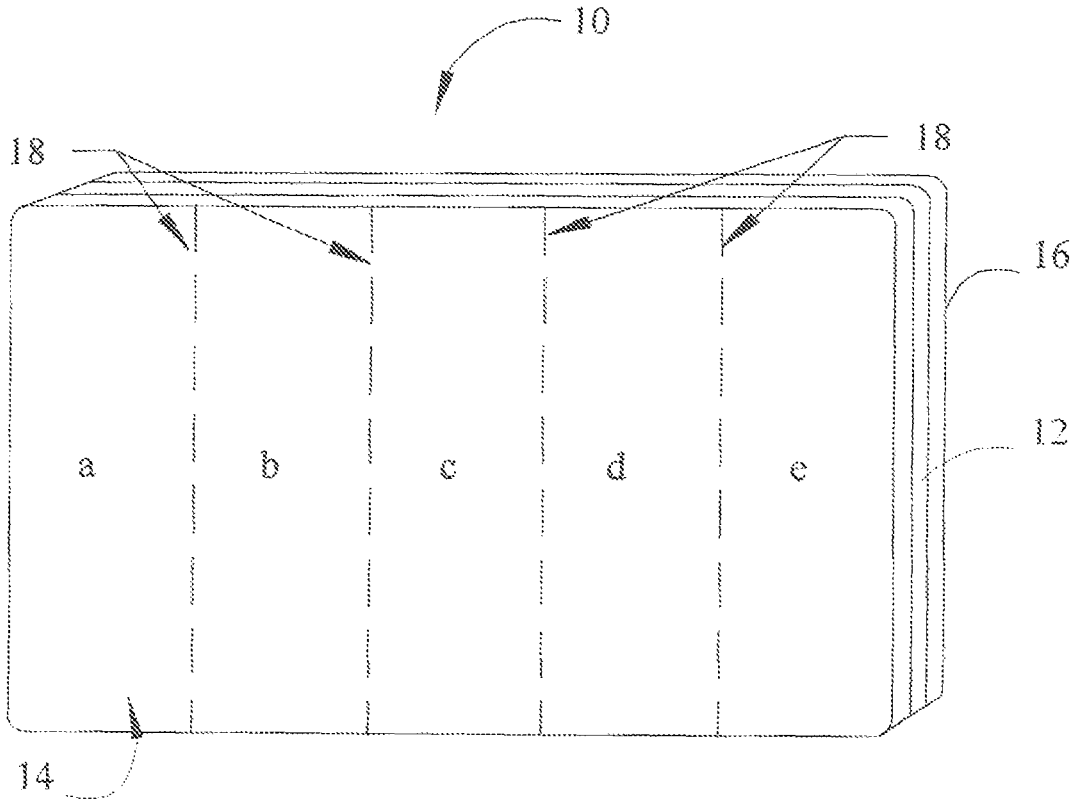

FIG. 1*b* provides a schematic view of a rectangular-shaped wipe having a plurality of sector-defining elements according to one embodiment of the present invention.

Figure 1C:
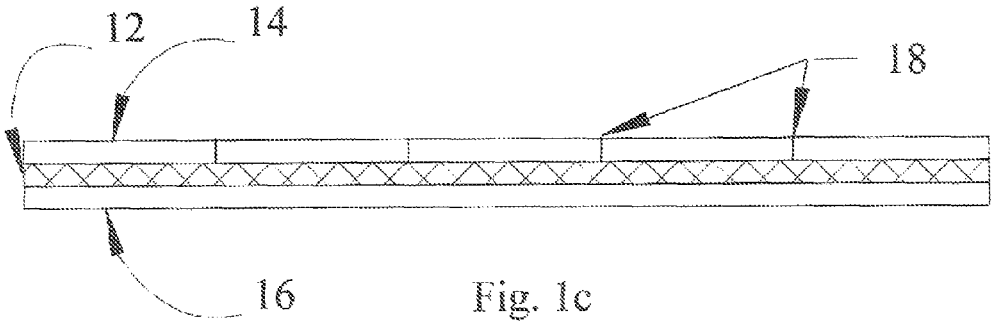

FIG. 1*c* provides a cross-sectional view of a tri-layered wipe having sector-defining elements on the front face according to one embodiment of the invention.

Figure 1D:
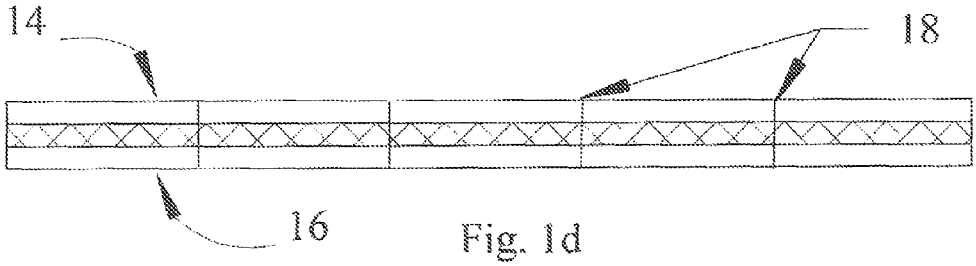
Figure 1E:
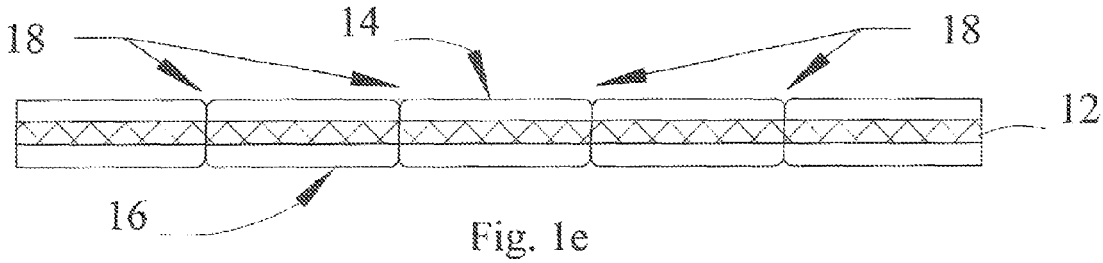

FIG. 1*d* provides a cross-sectional view of a tri-layered wipe having sector-defining, elements penetrating all layers. FIG. 1*e* is a cross-sectional view of another embodiment of the wipe of FIG. 1*d*.

Figure 1F:
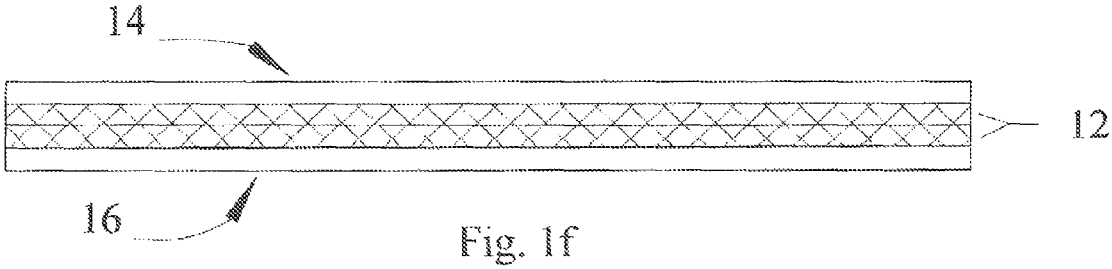

FIG. 1*f* provides a schematic representation of a multi-layered wipe embodiment having two inner layers.

Figure 2A:
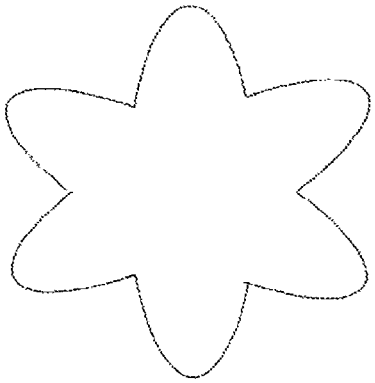
Figure 2B:
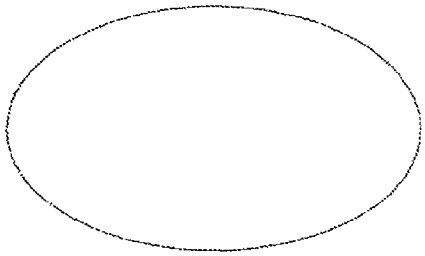

FIG. 2*a* depicts a schematic representation of a flower-shaped wipe,

FIG. 2*b* depicts a schema presentation of an ellipse-shaped wipe.

Figure 2C:
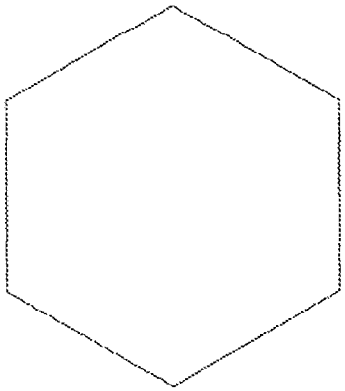

FIG. 2*c* depicts a schematic representation of a hexagonal-shaped wipe.

Figure 2D:
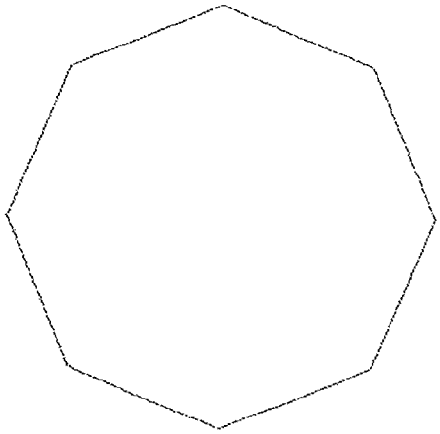
Figure 2E:
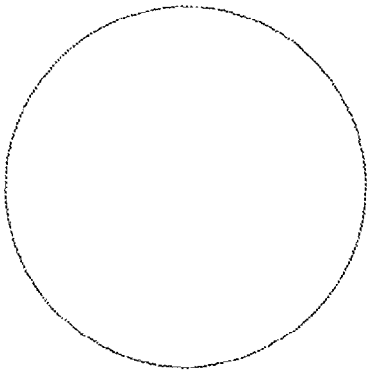

FIG. 2*d* depicts a schematic representation of an octagonal-shaped wipe,

FIG. 2*e* depicts a schematic representation of a circular-shaped wipe.

Figure 2F:
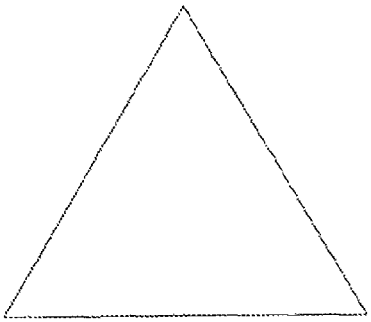

FIG. 2*f* depicts a schematic representation of a triangular-shaped wipe.

Figure 2G:
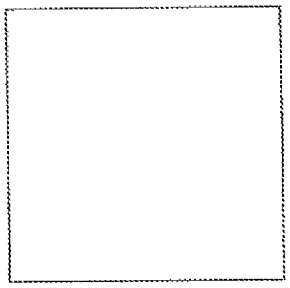

FIG. 2*g* depicts a schematic representation of a square-shaped wipe.

Figure 2H:
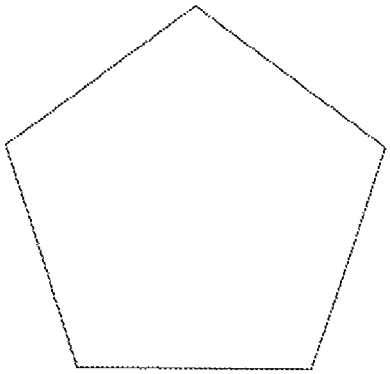
Figure 2I:
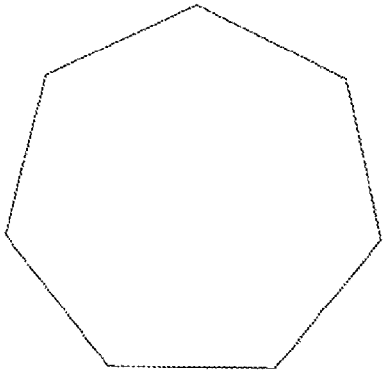

FIG. 2*h* depicts a schematic representation of a pentagonal-shaped wipe,

FIG. 2*i* depicts a schematic representation of a seven-sided wipe.

Figure 2J:
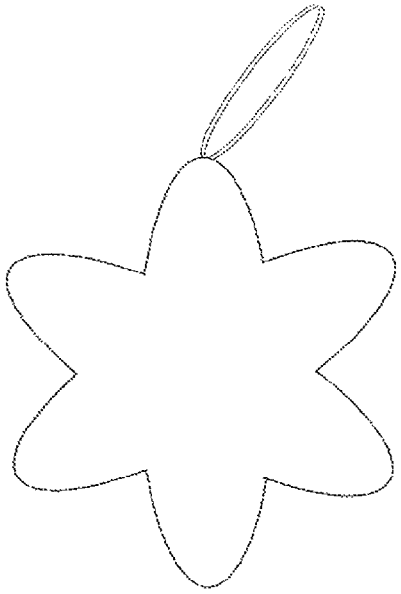
Figure 2K:
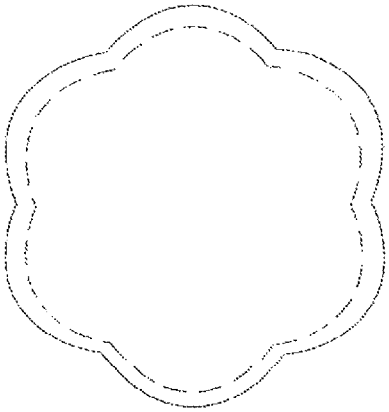

FIG. 2*j* depicts a schematic representation of a flower-shaped wipe with a convenience strap, FIG. 2*k* depicts a schematic representation of a flower-shaped wipe.

Figure 2L:
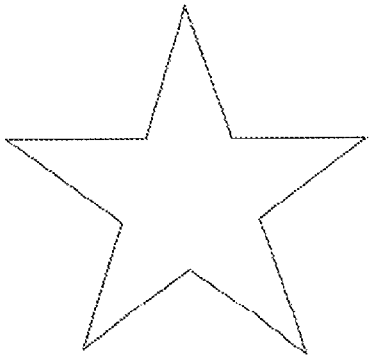

FIG. 2*l* depicts a schematic representation of a star-shaped wipe.

Figure 3A:
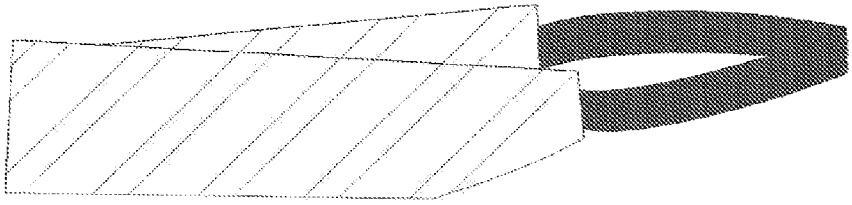

FIG. 3*a* depicts a schematic representation of an embodiment of a head band.

Figure 3B:
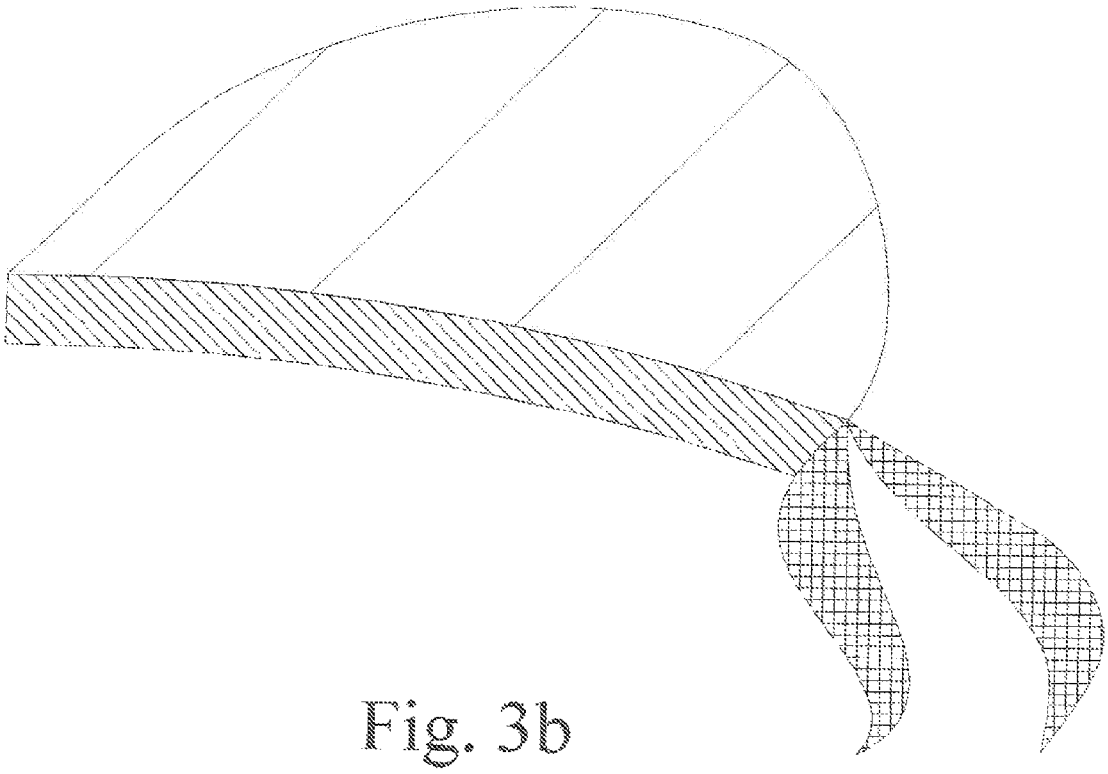

FIG. 3*b* depicts a schematic representation of an embodiment of a dew rag.

DETAILED DESCRIPTION OF PREFERRED EMBODIMENTS

As used herein the term "wipe" or "wiping cloth" refers generally to wipes, towels, rags, bands, and pads for a variety of consumer and/or personal uses. Wipes can have any desired size, shape, color, or design according to the desired application which may include, for example, personal use, office and household use, and leisure or sports use. Wipes and pads are used in a variety of ways, generally for absorbing liquids, for cleaning, and for applying and/or removing a substance to or from a surface of some object including but not limited to the surface of skin.

As used herein, the term "consumer product(s)" or "consumer use product(s)" refers to an article of manufacture that is used primarily by consumers for personal use including but not limited to hygienic use, in the home, office, or elsewhere for comfort, convenience and/or welfare. Exemplary hut not exclusive consumer products include wipes, pads, sponges, cloths, towels, hands such as head bands, dew-rags, and wrist bands, cleaning cloths, make-up removal and/or application pads, etc.

As used herein, the term "sector-defining element" describes an aspect of some embodiments of the invention in which at least one face of the outer layer of a wipe, or at least one face of the outer layer and at least one inner layer possess one or more structural elements such as a line, crease, channel, seal, stitch-line, indentation, depression, etc., or combination thereof, that creates one or more channels, boundaries, demarcations, or separations between the resulting regions or sectors of the wipe. Sector-defining elements are believed to enhance certain qualities of a wipe, for example, to improve the liquid absorbing and/or cleaning properties of a wipe and/or its utility for certain applications.

As used herein, the term "design" or "design pattern" refers to a non-structural feature relating in whole or in part to a wipe of the present invention, or to a piece of fabric from which such a wipe is constructed. A design can incorporate any element of color or style to appeal to the artistic or sentimental senses of a user.

The term "microfibers" means small diameter fibers having an average diameter not greater than about 75 microns, for example, having an average diameter of from about 1 micron to about 50 microns, or more particularly, having an average diameter of from about 1 micron to about 30 microns. As used herein the term is applied to fabrics, cloths, and materials that are used in the fabrication of synthetic and/or natural microfiber fabric materials, in one aspect, the present invention relates to the use of synthetic microfiber materials including, but not limited to, microfiber made from synthetic polymers, e.g. polyesters, polyamides (e.g. nylon, Kevlar, nomex, iron and mixtures thereof, Microfiber(s) and fabrics thereof may also comprise natural materials such as but not limited to, silk, bamboo, cotton, flax, hemp, jute, kapok, wool, and other animal fur.

The term "denier" is a unit of measure for the linear mass density of fibers. It is defined as the mass in grams per 9,000 meters. The term "filament" or "filament denier" refers to a single filament of fiber (also commonly known as Denier per Filament or D.P.F). The term "total denier" relates to a yarn, that is an agglomeration of filaments. A fiber is generally considered a microfiber if it is 1 denier or less. A 1-denier polyester fiber has a diameter of about 10 micrometers. Denier is used as the measure of density of weave in microfiber fabrics.

As used herein the term "Nylon" refers to polymer polyamides which can be obtained, for example, by the condensation polymerization reaction of a polyacid and a polyamine. Examples of various forms of nylon include nylon-6,6 [also known as poly(hexamethylene adipamide)]; nylon-6,10 [poly (hexamethylene sebacamide)]; nylon-6 [poly(pentamethylene carbonamide)]; nylon-11 [poly(decamethylene carbonamide)]; MXD-6 [poly(meta-xylene adipamide)]; PACM-9 [bis(para-aminocyclohcxyl)methane azelamide]; PACM-10 [bis(para-aminocyclohexyl)-methane sebacamide] and PACM-12 [bis(para-aminocyclohexyl)methane dodecanoamide]. Methods for preparing these nylon-type polyamides are well known to the skilled artisan. Preferably, the copolymer includes nylon-6 which can be prepared, for example, by the polymerization of caprolactam.

The term "spunbonded fibers" refers to small diameter fibers which are formed by extruding molten thermoplastic material as filaments from a plurality of line capillaries of a spinnerette having a circular or other configuration, with the diameter of the extruded filaments then being rapidly reduced as by, for example, in U.S. Pat. No. 4,340,563 to Appel et al, U.S. Pat. No. 3,692,618 to Dorschner et al., U.S. Pat. No. 3,801,817 to Matsuki et al. U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al. Spunbond fibers are quenched and generally not tacky on the surface when they enter the draw unit, or when they are deposited into a collecting surface. Spunbond fibers are generally continuous and may have average diameters larger than 7 microns, often between about 10 and 30 microns.

The term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin et al. Meltblown fibers are microfibers which may be continuous or discontinuous, are generally smaller than 10 microns in diameter, and are generally self bonding when deposited onto a collecting surface. Meltblown fibers used in the invention are preferably substantially continuous.

The term "polymer" generally includes but is not limited to, homopolymers, copolymers, including block, grail, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

The wipes and other articles of manufacture of the present invention have multiple advantages over other wipes including comfort for personal use, and enhanced absorption and cleaning capabilities. The surface of the wipes of the invention are non-abrasive and have a particularly soft feel, when used on the skin. Unlike other wipes that may have loops or other surface features that can irritate and feel rough on the skin, the wipes of the present invention provide articles that have a smooth, soft feel for added comfort for personal use applications.

A wide variety of synthetic polymers are suitable microfiber materials for fabricating articles of the present invention including, but not limited to, polyolefins (such as polymers of propylene and/or ethylene), polyesters, polyamides, polyurethanes and other melt-spinnable polymers. Exemplary polyolefins include one or more of polypropylene, polyethylene, ethylene copolymers, propylene copolymers, and butene copolymers. Useful polypropylenes include, for example, polypropylene available from the Exxon Chemical Company under the trade designation ESCORENE® PD3445, and linear low density polyethylene available from Dow Chemical Co. of Midland. Mich. under the trade designation ASPUN® 6811A and 2553. Numerous other polymers and formulations thereof suitable for melt-spinning are well known in the art. For example, particularly commercially useful polyamides are nylon-6, nylon 66, nylon-11 and nylon-12, These polyamides are commercially available from a number of sources such as Emser Industries of Sumter, S.C. (Grilon® & Grilamid® nylons) and Atochem Inc. Polymers Division, of Glen Rock, N. J. (Rilsan® nylons), among others.

In a preferred embodiment, articles of manufacture according to the present invention, are fabricated wholly or partly from 100% polyester; more preferably, from microfiber comprising about 80% polyester, and about 20% nylon. Suitable polyester and polyester blend fabrics are commercially available (E.g. Wujiang South Chemical Fibre Weaving Factory, Jiangsu, China under brand name NANFANG™).

In one embodiment, a hydrophilizing agent may optionally be applied to the microfiber to enhance the wettability of the fibers. Suitable hydrophilizing agents are well-known in the art and include, for example, surfactant materials or colloidal silica. If a surfactant is employed as a hydrophilizing agent, the type of surfactant can be anionic, cationic or nonionic, with nonionic materials being preferred. Suitable nonionic surfactants include the ethoxylated alcohols and ethoxylated alkylphenols.

A hydrophilizing agent can be applied to the synthetic microfibers at any convenient stage during manufacture. For example, a hydrophilizing agent may be incorporated with the microfiber-forming material before the microfibers are formed. Alternatively, a hydrophilizing agent may also be applied after synthesis and/or fabrication of the microfibers or articles made therefrom, for example, by spray application of a liquid nonionic surfactant. When used, a hydrophilizing agent will generally comprise no more than about 10% by weight of the absorbent micro fiber structures.

In one embodiment of the present invention, the microfibers are of about 0.01-50 microns in diameter; alternatively, from about 0.01-30 microns; alternatively from about 0.01-20 microns; alternatively from about 0.01-15 microns; still alternatively, from about 0.01-10 microns.

In another embodiment, the microfiber diameter is greater than about 15 microns; alternatively from about greater than 15 microns to about 50 microns; alternatively still, from about greater than 5 microns to about 30 microns.

In an embodiment of the present invention, the microfibers, fabrics and articles manufactured therefrom are of a density from about 0.01-0.15 g/cc; alternatively, from about 0.01-0.3 g/cc; alternatively, from about 0.01-0.5 g/cc.

Referring now to the drawings, and without intending to limit the scope of the invention, certain preferred embodiments of the invention will now be described in more detail.

A variety of articles of manufacture are contemplated by the present invention. In one embodiment, wipes and other articles are targeted for particular consumer use. For example, some wipes are targeted toward feminine utilities for use by women in one aspect, a wipe is fabricated with a shape and/or size that is appropriate for facial care such as cleansing or grooming, or for applying or removing make-up. In a preferred embodiment of this aspect, the wipe is configured with a flower-shape or star shape that not only appeals to the feminine senses but also contributes to the utility of the wipe in absorbing sweat, oils, or sebum from the skin, or in applying or removing make-up. A wipe according to this aspect may optionally include a convenience strap for ease of use, carriage, or placement when not in use (FIG. 2*j*). A convenience strap can be fabricated from any suitable material including synthetic or non-synthetic microfiber or ion-microfiber material including but not limited to cotton, paper, polyester, elastic, and synthetic blend. A strap can be fabricated as a single strap or as two or more pieces that are reversibly coupled by any suitable means known to the skilled artisan, including but not limited to buckle assembly, Velcro, snap, etc.

Other embodiments of the present invention include golf towels, head bands, wrist bands, facial cloths, sports towels, baby wipes, baby bibs, dew rags for boating, fishing, and motorcycling, shoe inserts, neck towels, and wipes for cleaning dust or other debris from surfaces including surfaces of electronic equipment.

In preferred embodiments, the wipes and articles of the present invention relate to multi-layered or laminated wipes having at least 3 layers; alternatively greater than 3 layers, for example, 4, 5, 6, 7, 8, 9, or 10 layers; alternatively still, greater than 10 layers. Preferably an article of the invention according to this aspect has from 3 to 8 layers; alternatively from 4 to 6 layers. Multi-layered wipes according to this aspect can be fabricated to have any desired thickness. Generally wipes are from about 0.1 to about 0.5 inches thick; alternatively from about 2 mm to about 15 mm in thickness, FIGS. 1*a*-1*f* depict embodiments of a multi-layered wipe according to the present invention. The wipe 10 comprises a front face 14 and a back face U, which are exposed to the environment and first come into contact with a liquid or other substance that is to be applied, removed, absorbed, or cleaned away. The wipe 10 further includes at least one inner layer 12 which together with the outermost layers (i.e. front face 14 and back face 16) define a laminated, multi-layered structure.

At least the outermost layer, including the front face 14 and back face 16, are fabricated from synthetic microfiber, most preferably 80% polyester, 20% nylon, Any one or more of the inner layers 12 can be fabricated from microfiber absorbent material, either natural or synthetic including, but not limited to cotton, silk, bamboo, wool, acrylic, nylon, polyester, olefin, cellulose, thermoplastic, polymer blends, etc., in any suitable form including sheets, woven and/or unwoven, melt-blown fiber, natural fiber, etc. In some embodiments, individual inner layers 12 may be fabricated from materials other than microfiber. That is, one or more inner layers 12 may be fabricated from microfiber for example, synthetic microfiber, while at least one other inner layer 12 is fabricated from a material other than microfiber, for example, sponge or sponge-like material. Preferably at least one inner layer is fabricated from synthetic microfiber, most preferably 80% polyester, 20% nylon.

Fabricating multiple layers into a multi-layered wipe, i.e. incorporating one or more inner layers between the outer layer may be accomplished by any suitable method known to the skilled artisan including, for example, sewing, melt-bonding, gluing, and the like. The outermost layer may be fabricated from a single piece of fabric, or from separate pieces of fabric. For example, a single sheet of fabric may be folded to achieve the desired shape for the wipe. Alternatively, the outermost layer of a wipe or other article may comprise two or more pieces of fabric that are cut to the desired shape and bonded, sewn, or otherwise joined together with one or more appropriately shaped inner layers. For example, layers may be bound together by stitching or any other suitable method to ensure the integrity of a multi-layered wipe.

In some aspects, wipes of the present invention are used for the removal or absorption of body fluids, for example, sweat and/or sebum, from the face or other part of the body. For this purpose, it is preferable to provide a smooth, non-abrasive texture so as not to irritate the skin. It is also desired to provide a wipe that effectively removes aqueous and non-aqueous liquids. The wipes of the present invention provide these and other features.

Without intending to be bound by any particular theory, it is believed that both the structure of the wipe and the material from which it is made contribute to the aforementioned desirable features. The outer layer of a wipe or other article is exposed to the environment and makes contact with the surface to be wiped, e.g. the skin. The outer layer is fabricated from microfiber material, preferably a synthetic microfiber such as 80% polyester, 20% nylon. This material has a smooth texture providing comfort for personal use for absorbing liquids from sensitive regions, for example, facial area around the nose, eyes, and mouth.

In some embodiments, the wipes of the present invention are fabricated with certain structural and/or design features that contribute to their efficacy and utility in absorbing liquids, including sweat and sebum. In one aspect, wipes of the invention are used cosmetically to apply and/or remove make-up. In another aspect, a wipe of the invention is used for body cleansing, e.g. facial cleansing where removal of oils, e.g. sebum, can be challenging. In another aspect, wipes of the invention can be used to remove sweat from any part of the body, for cosmetic and/or comfort during exercise, work, some type of performances and sports activities, or otherwise when circumstances induce sweating.

The effectiveness of wipes of the invention in removing liquids can be explained on the basis of one or more of the following features. First, the wipes are preferably fabricated with multiple layers which contributes to the efficient wicking properties of the wipe (FIG. 1*a*-1*f*). Second, in some embodiments the wipes are fabricated in one or more geometric or other shapes including, but not limited to, square, rectangle, triangle, rhombus, hexagon, pentagon, oval, circle, polygonal, flower-shaped, star-shaped, etc. and derivatives thereof, having straight or curved edges. For example, FIGS. 2*a*-2*l* depict various embodiments of wipes having distinct flower or other geometric shapes. FIG. 2*k* schematically displays a wipe showing the stitch line by which the pieces are sewn together (dashed line near edge). The outer layer of a wipe or other article of the present invention may incorporate any desired geometric or non-geometric design pattern for purposes of aesthetic, sentimental, activity-themed, age-appropriate, or gender-specific appeal.

In some embodiments, a wipe is fabricated in a particular shape to appeal to certain users, for example, animation or cartoon characters may be adopted to appeal to infants and/or children, or sports shapes such as balls or other implements used in sports such as baseball, football, soccer, golf, tennis, martial arts, boxing, wrestling, swimming, and the like. Alternatively, wipes of the invention may be fabricated with a shape and/or design to reflect certain sporting teams, or team mascots, and/or team logos to appeal to sports enthusiasts.

The shape of a wipe of the invention can also contribute to its utility. For example, use of a wipe as a facial wipe is facilitated by a plurality of surface area sub-regions, including but not limited to a floral-shaped or star-shaped patterns, which provide easier access to particular regions of the face that are of a constricted size and/or convexly or concavely configured, such as around the eyes, ears, forehead, jaw-line, nose and mouth, Thus, the particular shape of a wipe is believed to enhance the utility of a wipe according to the invention for various applications such as but not limited to removing liquids from the body and/or applying and removing make-up from the face.

Wipes of the present invention generally possess a front face 14 and back face 16 (FIGS. 1*a*-1*f*). The front face 14 and/or back face 16 may be smooth (FIG. 1*a*) or possess one or more sector defining elements 18 (FIGS. 1*b*-1*e*). In one embodiment, the wipes of the present invention are designed with certain features that enhance their utility and efficacy as liquid absorption wipes. In one aspect, the surface of a wipe possesses a plurality of sub-regions or sectors, defined by at least one sector-defining element 18. The sector-defining element provides and/or creates a boundary between sub-regions of a wipe (marked "a", "b", "c", "d", and "e" in FIG. 1*b*). According to this aspect, wipes are designed to possess at least two sectors, or sub-regions, that divide the surface area of a wipe and optionally one or more inner layer(s). A sector defining element 18 may be limited to the outer layer, or it may penetrate one or more inner layer(s) (FIGS. 1*c* & 1*d*). In certain embodiments, a wipe of the invention has 2, 3, 4, 5, 6, 7, 8, 9, 10, or greater than 10 such sub-regions. The sector-defining element 18 between sub-regions produces a plurality of sub-regions on the wipe, each of which constitutes an absorbent sub-region of the wipe. Instead of a single liquid-absorbing sink, defined by the entire wipe and surface area thereof, a wipe according to this aspect of the invention results in a sequestering of absorbed liquid onto and/or into sub-regions of the wipe, thereby resulting in sectoring of liquid absorption such that certain sub-regions of the wipe remain in a partially or substantially drier state than others depending on usage. This feature is advantageous for certain, uses.

Sector-defining element(s) of the wipes are produced by any suitable method known to the skilled artisan, including, but not limited to, creating the boundary(ies) by sewing, melt-bonding, gluing, tacking, etc. Preferably the sub-sectioning of a wipe according to this aspect of the invention does not significantly reduce the comfort and fed of the smooth surface provided by the outer microfiber layer.

In certain embodiments, the sector-defining element 18 is primarily limited to the outer layer(s), or the outer layer plus a subset (i.e. less than all) of the inner layers. In other embodiments the sector-defining element(s) penetrate through all, or substantially all layers of a wipe of the invention. The moisture absorption properties of a wipe having this feature may be affected by the number and placement of the sector-defining elements, and by the degree to which the sector-defining element(s) penetrate the composite layers of a wipe.

In still other embodiments, a wipe of the invention possesses a smooth or continuous surface area, that is, it lacks a sector-defining element(s) (FIG. 1*a*).

Other embodiments of the invention relate to articles of manufacture comprising wipe(s) for use in applying or removing make-up. In one embodiment, the invention relates to a wipe in combination with a make-up case or compact. Make-up compacts generally comprise a casing or base comprising one or a plurality of compartments intended to contain a make-up product such as eye-shadow or foundation, and an applicator or wiping device to apply and/or remove make-up. Thus, the present invention also includes a make-up compact or the like comprising one or more microfiber wipes of the present invention. A wipe according to this aspect preferably has at least one inner layer. In some embodiments a wipe according to this aspect comprises at least one inner layer that is fabricate from sponge or sponge-like material.

In other embodiments of the invention, the fabrics and/or microfibers from which articles such as wipes are fabricated may optionally include other agents such as medicaments, disinfectants such as anti-microbial agents to reduce the growth of micro-organisms, insect repellants, antifungal agents, and/or agents to increase or decrease hydrophobicity or hydrophillicity to modify liquid absorption characteristics. Such agents may facilitate use of wipes for certain purposes including to enhance sterility, reduce the risk of infection, or provide medication or other agent, etc. For example, wipes and/or the microfiber material from which they are made may be treated with an antimicrobial agent, such as 3-(trimethoxysilyl)propyloctadocyldimethyl ammonium chloride. See U.S. Pat. No. 6,712,121, and U.S. Pat. No. 6,946,196, and references cited therein, expressly incorporated herein by reference.

In another aspect the present invention relates to the use of an article according to the present invention for wiping and/or cleaning liquids, smudges, oil, dust or other debris from the surface of electronic equipment such as, but not limited to, the screen area of computers, computer tablets, and smart phones. For this purpose, a wipe of the invention may be used alone or in combination with a commercially available cleaning or dusting agent.

While the synthetic microfiber materials, articles of manufacture, and uses thereof as described herein constitute certain preferred embodiments of the invention, it should be understood that the invention is not limited to the precise form of apparatus or device or material, and that changes may be made therein without departing from the scope of the invention.

What is claimed is:

1. A synthetic microfiber fabric wiping cloth having a plurality of fabric layers said wiping cloth having a front face and a back face that define a surface area wherein said front face and back face each have a sector-defining element that produces a boundary between two absorbent sub-regions on the surface area of each of said front face and back face, and wherein said wiping cloth has a density of about 0.01-0.5 g/cc and each of said layers is fabricated from 80% polyester, 20% nylon and wherein said wiping cloth has a flower-shape having six ovular-shaped petals projecting outwardly from a central region.

* * * * *